US005732999A

United States Patent [19]

Petrie

[11] Patent Number: 5,732,999

[45] Date of Patent: Mar. 31, 1998

[54] PORTABLE INFANT ACTIVITY CENTER

[75] Inventor: Aidan J. Petrie, Providence, R.I.

[73] Assignee: Item New Product Development, Inc., Providence, R.I.

[21] Appl. No.: 638,012

[22] Filed: Apr. 25, 1996

[51] Int. Cl.[6] ..... A47B 83/02

[52] U.S. Cl. ..... 297/136; 297/488; 446/227

[58] Field of Search ..... 297/136, 174, 297/135, 488, 217.7, 250.1; 108/43; 446/227

[56] References Cited

U.S. PATENT DOCUMENTS

| | | | |
|---|---|---|---|
| D. 330,978 | 11/1992 | Vasquez . | |
| 2,723,856 | 11/1955 | Thomson | 446/227 X |
| 3,029,551 | 4/1962 | Reiskin | 446/227 |
| 3,271,091 | 9/1966 | Henry . | |
| 3,606,457 | 9/1971 | Reay | 297/488 |
| 3,957,303 | 5/1976 | Mauron | 297/488 X |
| 4,094,547 | 6/1978 | Zampino et al. . | |
| 4,312,507 | 1/1982 | Smith et al. . | |
| 4,594,072 | 6/1986 | Cowell | 446/227 |
| 4,673,216 | 6/1987 | Alfer . | |
| 4,790,041 | 12/1988 | Shtull | 108/43 X |
| 4,826,208 | 5/1989 | Ozmar | 297/488 X |
| 4,889,388 | 12/1989 | Hime . | |
| 4,971,389 | 11/1990 | Staggs et al. . | |
| 5,005,902 | 4/1991 | Farnworth et al. | 297/250.1 |
| 5,071,192 | 12/1991 | Adler . | |
| 5,134,930 | 8/1992 | Mei-Hwa . | |
| 5,327,838 | 7/1994 | Beltman . | |
| 5,527,091 | 6/1996 | Gruber | 297/188.01 |
| 5,580,125 | 12/1996 | Alger | 297/250.1 |
| 5,580,132 | 12/1996 | Rediske | 108/43 X |

FOREIGN PATENT DOCUMENTS

| | | | |
|---|---|---|---|
| 2621479 | 11/1976 | Germany | 297/488 |
| 3313870 | 10/1984 | Germany | 297/488 |
| 3517841 | 11/1986 | Germany | 297/488 |
| 1385548 | 2/1975 | United Kingdom | 108/43 |

*Primary Examiner*—Peter M. Cuomo
*Assistant Examiner*—David E. Allred
*Attorney, Agent, or Firm*—John E. Reilly

[57] ABSTRACT

An infant activity center includes a bolster of a shape that will at least partially encircle an infant while providing an elevated playing surface. Preferably U-shaped, the bolster is made up of a plurality of dense foam pad sections encased and united in a removable, washable outer cover. A padded seating portion substantially traverses a center region defined by the pad sections. The upper surface of the cushion preferably includes a variety of toys secured thereto. The foam pad sections may include compartments or recesses for cups, toys or other items.

16 Claims, 2 Drawing Sheets

PORTABLE INFANT ACTIVITY CENTER

BACKGROUND AND FIELD OF INVENTION

This invention relates to infant activity devices; and more particularly relates to an infant activity center which will at least partially surround an infant while providing an elevated playing surface.

The "baby products" market offers a plethora of products for entertaining, caring for, and generally, making life comfortable for infants and toddlers. A good investment for many parents is some type of seat or tray where a baby can be placed and safely entertained without the danger of falling out of a seat.

It has been proposed to provide devices to meet this need in the form of traditional highchairs or other seats which have a tray where an array of toys may be placed for the baby's amusement. For instance, U.S. Pat. No. 5,071,192 to L. J. Adler discloses such a seat having an adjustment mechanism to accommodate various sized individuals, including infants, and having a detachable, U-shaped tray for a work or play surface. U.S. Pat. No. 4,971,389 to R. H. Staggs et al discloses a similar U-shaped tray for attachment to an adult chair, thereby converting the chair into an infant's highchair. As shown in U.S. Pat. No. 4,094,547 to A. T. Zampino et al, a circular or oval tray, having a U-shaped opening in its center to accommodate the body of a child, is adapted for attachment to a standard chair, again converting the chair to a type of highchair.

The disadvantages of the above inventions and the common, traditional highchair relate to the relative height of the tray-play area to the floor and the infant's or toddler's confinement within a chair. Toys often get thrown or dropped to the floor when a child is placed in a highchair, requiring the parent to constantly retrieve the toys or else listen to a disgruntled baby. The child, too, usually grows restless after only a short time from being kept confined in a seated position.

Other prior art trays and play tables, such as those shown in U.S. Pat. Nos. 4,312,507 to B. E. Smith et al, 5,134,930 to H. Mei-Hwa and 5,327,838 to C. H. Beltman are supported by leg structures located at opposite longitudinal ends of the trays, thus allowing the trays to be placed over the user's lap or upon another support surface. Neither Smith's game tray, Beltman's tray table nor Mei-Hwa's inflatable serving tray is intended for direct placement on the floor so that the bottom of the tray portion directly contacts the floor. Neither do any of these inventions disclose an intended use as a play or activity center for a child wherein a child may sit within a U-shaped recess within the tray while using the tray or table.

While U.S. Pat. No. 4,673,216 to J. G. Alfer shows a generally U-shaped padded cushion that may be placed directly on the floor, it is intended to be used-by someone who has assumed the lotus, or meditating, position, and thus must conform to the shape of the user's folded legs and buttocks. Alfer's cushion does not suggest a play area or bolster for use by a child due to its relatively flattened shape.

Other representative patents are U.S. Pat. Nos. 4,889,388 to S. R. Hime, 3,271,091 to J. Henry and Design Pat. No. 330,978 to G. A. Vasquez.

Thus, a need exists for a floor bolster of a shape which will partially encircle or surround an infant while providing an elevated playing surface at a height where the child can conveniently play or reach toys without the danger of falling or can sit or kneel comfortably against the bolster while playing.

SUMMARY OF THE INVENTION

It is therefore an object of the present invention to provide for a novel and improved infant activity center which will at least partially encircle or surround the infant.

It is another object of the present invention to provide a device that has an elevated playing surface for use by the child when seated or kneeling on the floor or ground.

It is a further object of the present invention to provide a device that has compartments and toys on its outer surfaces.

It is yet a further object of the present invention to provide a portable activity center of soft, pliable material that is of a size, shape and weight to allow a small child or adult to carry the center by a strap secured to its outer surface.

Yet another object of the present invention is to provide a bolster which has a padded seating area wherein an infant may comfortably kneel or sit while playing.

In accordance with the present invention, an infant activity center comprises a bolster of generally U-shape that will at least partially encircle an infant while providing an elevated horizontal playing surface at a closed end of said bolster. Preferably U-shaped, the bolster is encased in a removable and washable fabric cover to which a carrying handle is secured. Within the center of the bolster is a seating area having a padded fabric portion secured to its lower surface. The upper surface of the bolster, of sufficient height to allow an infant or a small child to kneel or sit within the center of the bolster, includes a variety of toys and other amusements with which the child can play. In addition, the upper surface of the bolster may include compartments for cups, toys or other items.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 2:
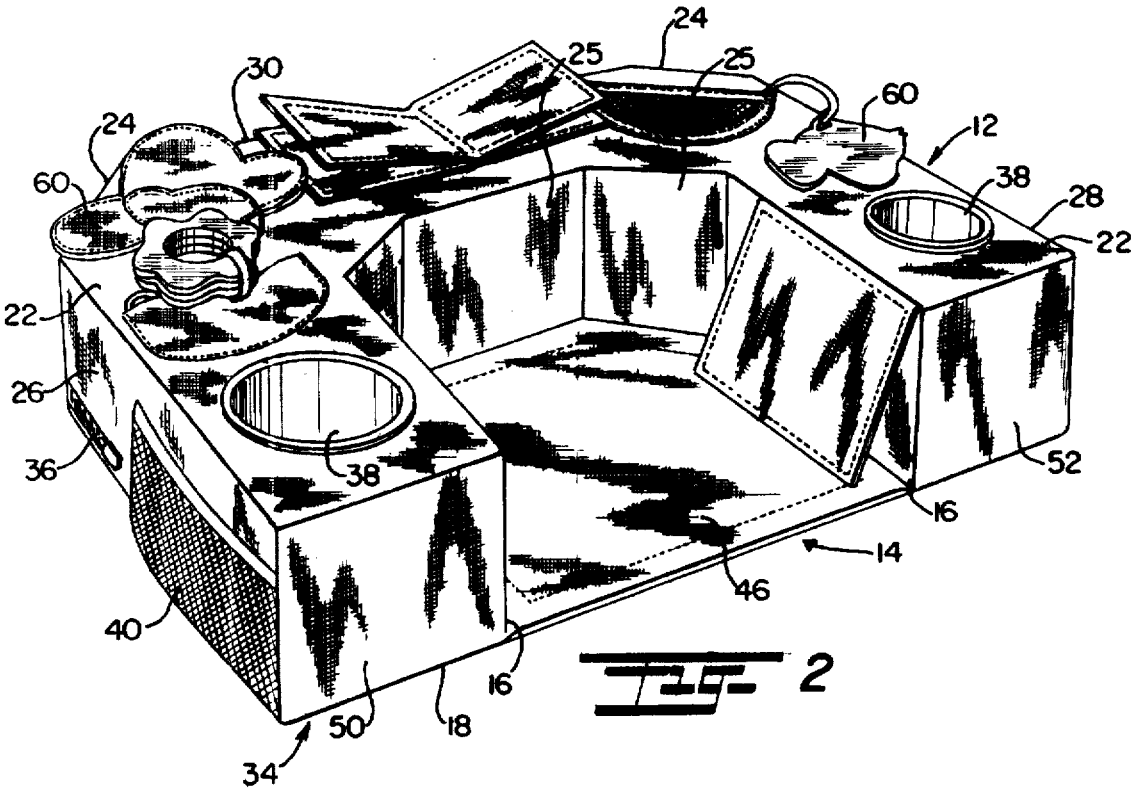
FIG. 2 is a perspective view illustrating the seated area and the compartments within the center's upper surface.
Figure 1:
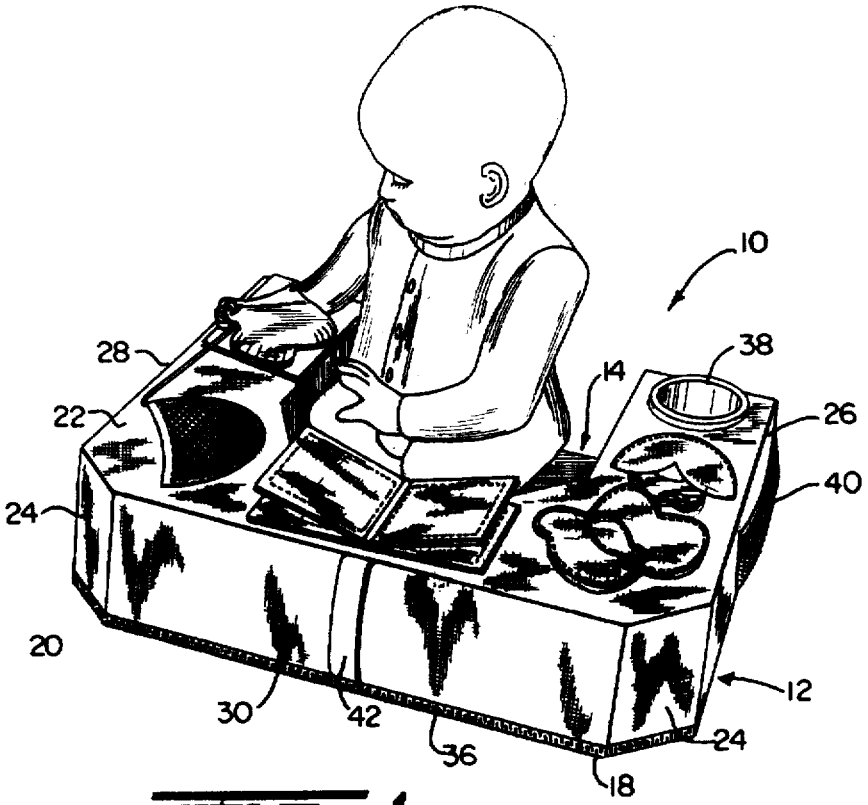
FIG. 1 is a perspective view of the infant activity center of the present invention.

Referring now to the drawings, wherein like reference numerals designate corresponding structure throughout the views, and referring in particular to FIGS. 1 and 2, a preferred form of the invention takes the form of an activity center 10 which is broadly comprised of a resilient bolster 12 having a shape which will at least partially surround an infant seated in a center region 14 which is defined by an inner periphery 16 of the bolster 12. The bolster 12 comprises a flat continuous bottom horizontal surface 18 for placement on a support surface 20 and an elevated upper horizontal surface 22 which is raised above the surface 18 sufficient to provide a playing surface for the infant or toddler. A plurality of outer vertical walls 24 and inner vertical walls 25 extend perpendicularly between the upper and lower surfaces 22 and 18, respectively.

Figure 3:
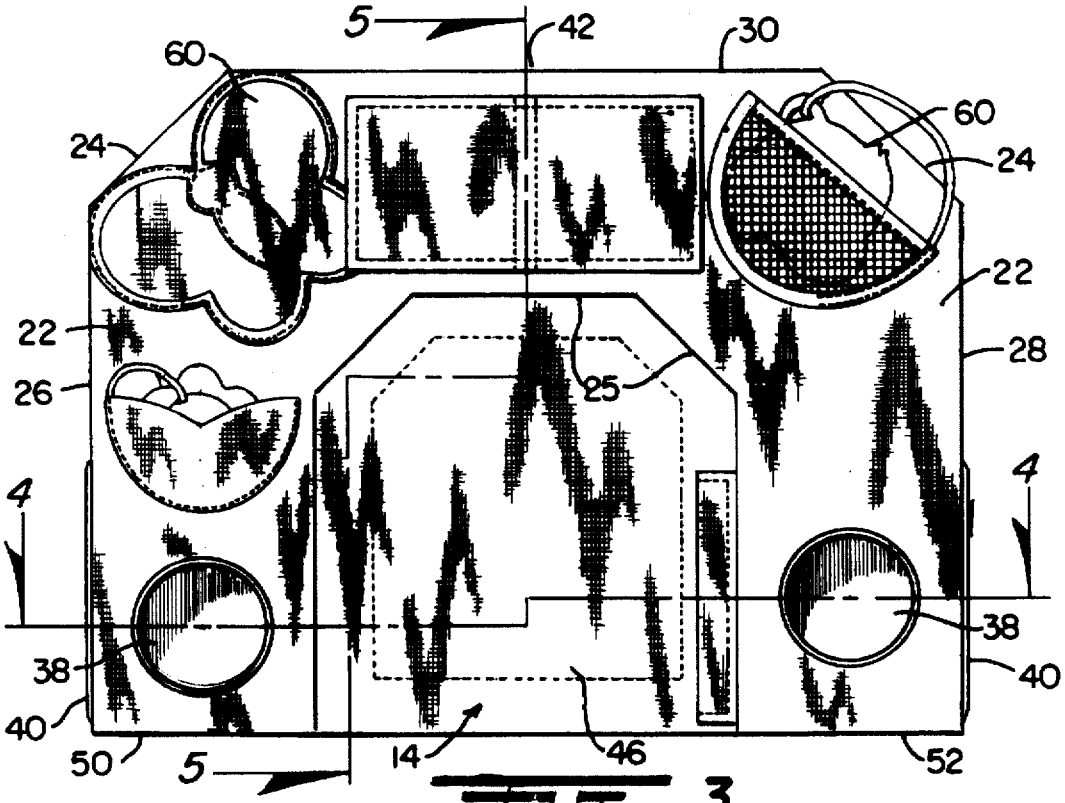
FIG. 3 is a top plan view of the activity center.

As FIGS. 1 through 3 illustrate, the bolster 12 is made up of three oblong cellular foam pad sections of uniform cross-sectional size and configuration throughout, each generally rectangular in cross-section and arranged together to be of generally U-shaped configuration having opposed, substantially parallel side arms 26, 28 each of which has a free end terminating in an end wall 50, 52. A closed end 30 joins the side arms 26, 28 and together define a center region 14 where a child may kneel or sit to manipulate the objects mounted on the center 10, as shown in FIG. 1.

Each of the three oblong cellular sections which comprise the bolster 12 are preferably made of a very dense foam material, such as polyurethane foam or a similar material which is characterized by a sturdy resiliency that will substantially maintain its shape when the child leans or sits against the bolster 12.

Encasing the bolster 12 and uniting the cellular foam pad sections 26, 28 and 30 together into a U-shaped form is an outer cover 34 which includes an opening for removing the foam sections from the outer cover 34, and a zipper 36 which extends along the length of the closed end section 30, proximate to the bottom surface 18. The outer cover 34 is preferably made of a durable and washable fabric, such as cotton or polyester.

Figure 4:
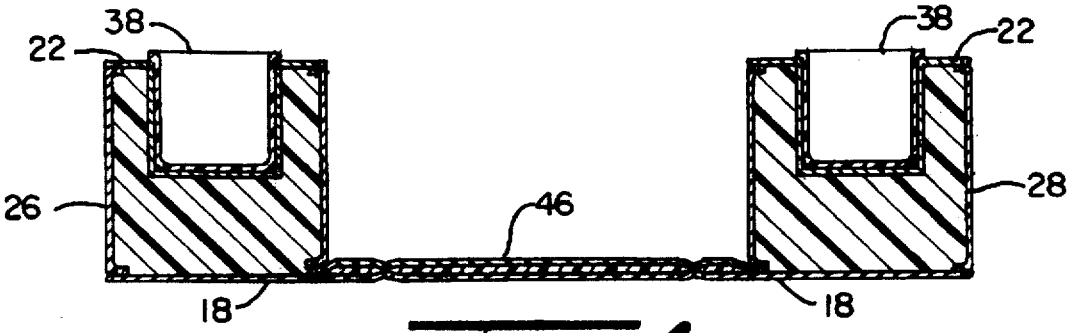
FIG. 4 is a front view of the activity center partly in cross-section taken along lines 4—4 of FIG. 3.
Figure 5:
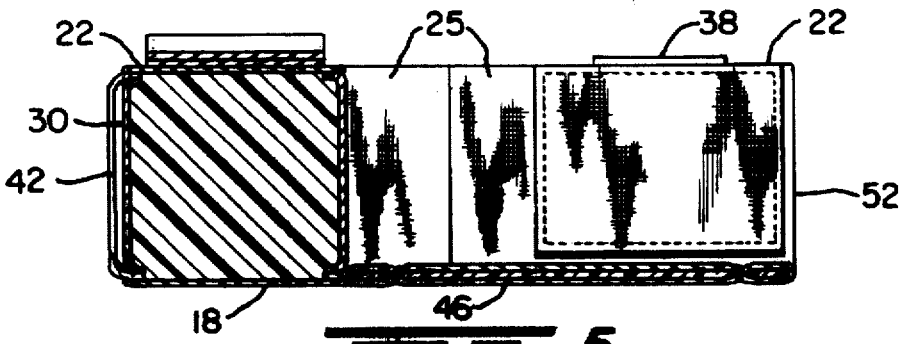
FIG. 5 is a side view of the activity center partly in cross-section, taken along lines 5—5 of FIG. 3.

As shown in FIG. 4, the bolster 12 preferably includes at least one compartment 38 at a free end of each side arm 26, 28 and extending downwardly through the upper play surface 22 and pad sections 26, 28, 30 towards the bottom surface 18. These compartments 38 are shown in the illustrations as circular for holding child-sized cups or bottles, toys and crayons, but other sizes and shapes of compartments or recesses may be employed as well.

As noted above, while the infant activity center 10 is shown as preferably U-shaped, the bolster 12 could also be of a broader arcuate shape, substantially rounded, or fully circular, with the foam pad sections cut in such a way to create these configurations when combined and encased in the outer cover 34. In any event, it is intended that the bolster 12 define a center region 14 such that the baby may be at least partially surrounded by the bolster 12. In a preferred form, the center region 14 has a padded seating portion 46 which extends between the lower surfaces of the arms 26, 28 and enclosed end 30, and which also contacts the support surface 20. The padded seating portion 46 may be made of the same type of fabric as the outer cover 34 and may be filled with a resilient fiber to provide a comfortable area for the child.

The inner or outer walls 24, 25 may include netted pockets 40 in which items may be stored, and a carrying handle 42, shown in FIG. 1, may be secured to the outer cover 34 thereby enabling a toddler to effectively move the activity center 10.

As noted earlier, the center 10 is contemplated for use as an infant activity center, and generally constructed in a shape and of a weight and bulk which a small child can handle, with the outer cover 34 preferably of a colorful design that is attractive and appealing to a child. The upper surface 22, intended for use as a play surface when the child sits in the center region 14 or leans against the bolster 12, includes a variety of toys and other gadgets 60 secured thereto designed for a small child's amusement.

It is therefore to be understood that while the preferred form of the invention is herein set forth and disclosed, various modifications and changes may be made therein without departing from the spirit and scope of the present invention as defined by the appended claims.

I claim:

1. A portable infant activity center for placement on a support surface comprising:

a bolster of generally U-shaped configuration having substantially parallel upright opposite sides and an upright closed end in the form of resilient padding filled sections to define an open center region therebetween for an infant seated therein in facing relation to one of said sides or closed end, said bolster having a flat, continuous horizontal bottom surface at least along said closed end for placement on said support surface and elevated upper horizontal playing surfaces on said sides and closed end in substantially coplanar relation to one another; and a seating pad in said center region wherein said bolster and said seating pad together are integral and wherein said seating pad comprises a fabric panel contactable with said support surface and joined to said bolster thereby forming with said bottom surface a continuous planar lower surface for placement on said support surface.

2. An infant activity center according to claim 1 wherein said bolster is comprised of a plurality of cellular pad sections.

3. An infant activity center according to claim 1 wherein said sections are made of resilient dense foam and said upper horizontal playing surface is on said closed end and on both said opposite sides.

4. An infant activity center according to claim 1 wherein said bolster is of generally rectangular cross-section.

5. An infant activity center according to claim 1 wherein said bolster includes at least one compartment therein extending from said upper surface toward said bottom surface.

6. An infant activity center according to claim 2 further comprising an outer cover encasing said foam pad sections, thereby uniting said pad sections into said U-shaped configuration.

7. An infant activity center according to claim 6 wherein said outer cover includes a closable opening through which said foam pad sections are removable.

8. An infant activity center according to claim 1 wherein said bolster further comprises at least one outer vertical wall and at least one inner vertical wall and at least one pocket on at least one of said vertical walls.

9. A portable infant activity center according to claim 1 wherein said playing surfaces have toys secured thereto.

10. An infant activity center according to claim 6 wherein said toy comprises a book.

11. An infant activity center adapted for placement on a floor surface, comprising:

a generally U-shaped bolster comprised of a plurality of dense foam pad section said pad sections encased by an outer cover thereby uniting said pad sections into said U-shaped configuration having two substantially parallel side arms and a closed end joining said side arms, said side arms and said closed end each comprising at least one separate pad section provided with a flat continuous bottom surface for placement on said support surface, elevated upper horizontal playing surfaces on said side arms and said closed end, and an open center region surrounded by said foam pad sections; and a seated portion in said center region comprising a fabric panel joined to said bolsters and having a lower surface coplanar with said bottom surface of said bolster.

12. An infant activity center according to claim 11 wherein said foam pad sections are made of polyurethane.

13. An infant activity center according to claim 11 wherein said bolster includes a plurality of toys secured to said outer cover.

14. An infant activity center according to claim 11 further comprising a handle secured to said outer cover for carrying said activity center.

15. An infant activity center according to claim 11 further comprising at least one pocket upon said outer cover.

16. An activity center according to claim 11 wherein at least one compartment within said foam pad sections extends from said upper horizontal playing surface toward said bottom surface.

* * * * *